US009718517B2

(12) United States Patent
Zirkelbach et al.

(10) Patent No.: US 9,718,517 B2
(45) Date of Patent: Aug. 1, 2017

(54) RATCHET PLAYPEN COVER FOR A PONTOON BOAT

(71) Applicant: Taylor Made Group, LLC, Gloversville, NY (US)

(72) Inventors: Donald A. Zirkelbach, Bradenton, FL (US); Daniel James Serafini, Churubusco, IN (US)

(73) Assignee: TAYLOR MADE GROUP, LLC, Gloversville, NY (US)

( * ) Notice: Subject to any disclaimer, the term of this patent is extended or adjusted under 35 U.S.C. 154(b) by 0 days.

(21) Appl. No.: 14/462,839

(22) Filed: Aug. 19, 2014

(65) Prior Publication Data

US 2015/0047550 A1 Feb. 19, 2015

Related U.S. Application Data

(60) Provisional application No. 61/867,277, filed on Aug. 19, 2013.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02; B63B 59/00
USPC ..... 114/361
See application file for complete search history.

(56) References Cited

U.S. PATENT DOCUMENTS

| | | | | |
|---|---|---|---|---|
| 4,244,487 | A | 1/1981 | Kern | |
| 5,564,358 | A * | 10/1996 | Newton | 114/361 |
| 5,813,360 | A * | 9/1998 | Dickey, Jr. | 114/161 |
| 5,816,185 | A * | 10/1998 | Ruthrford | 114/361 |
| 6,129,034 | A * | 10/2000 | Santa Cruz et al. | 114/361 |
| 6,260,505 | B1 | 7/2001 | Polidan | |
| 6,681,713 | B2 | 1/2004 | Scott et al. | |
| 6,810,829 | B1 * | 11/2004 | McDaniel | 114/361 |
| 7,395,775 | B2 | 7/2008 | LaScala | |
| 7,418,919 | B2 * | 9/2008 | Smith | B63B 17/02 114/361 |
| 7,455,027 | B1 | 11/2008 | Dickerson | |
| 7,484,472 | B1 | 2/2009 | Highfield | |
| 7,555,994 | B1 | 7/2009 | Arnall | |
| 8,359,994 | B1 | 1/2013 | Highfield | |
| 8,875,646 | B2 * | 11/2014 | Zirkelbach | B63B 17/02 114/361 |
| 2007/0095271 | A1 * | 5/2007 | Yang | 114/361 |

* cited by examiner

*Primary Examiner* — Lars A Olson
(74) *Attorney, Agent, or Firm* — Nixon & Vanderhye P.C.

(57) ABSTRACT

A playpen cover for a pontoon boat includes a cover panel sized to cover a pontoon boat deck, where the cover panel has loop channel. A ratchet loop is disposed in the loop channel and is attachable at ends of the ratchet loop to respective boat cleats. A ratchet system cooperable with the ratchet loop is disposed between the boat cleats. The ratchet loop attaches to the boat cleat and requires no fastener.

13 Claims, 4 Drawing Sheets

RATCHET PLAYPEN COVER FOR A PONTOON BOAT

CROSS-REFERENCES TO RELATED APPLICATIONS

This application claims the benefit of U.S. Provisional Patent Application Ser. No. 61/867,277, filed Aug. 19, 2013, the entire content of which is herein incorporated by reference.

STATEMENT REGARDING FEDERALLY SPONSORED RESEARCH OR DEVELOPMENT (NOT APPLICABLE)

BACKGROUND OF THE INVENTION

The invention relates to a boat cover and, more particularly, a ratchet playpen cover for a pontoon boat that can be quickly and easily installed.

Boat covers for storage and/or transport can be difficult and burdensome to install. A pontoon boat has a particularly wide deck, which can increase the difficulty in installing a boat cover.

Typically, a boat cover includes snaps or similar fasteners around an end perimeter thereof. Complementary snap fasteners are secured to the boat hull, and after positioning the boat cover over the boat deck, the cover is secured by engaging the snap fasteners. In addition to the time required to engage all of the snaps around the boat deck, the cover material tends to lose its shape over time, making it difficult to engage all of the snaps, which are fixed to the boat hull.

Additionally, most boat covers are constructed for installation on dry land. The requirement can be burdensome when it is desirable to install a cover with the boat in the water.

BRIEF SUMMARY OF THE INVENTION

It would be desirable for a boat cover to be more easily secured. The boat cover according to preferred embodiments allows for significant reduction of installation time versus a conventional snap-on cover. The cover includes a ratchet loop that attaches to the boat cleat and requires no fastener. A ratchet system provides for tensioning of the ratchet loop, and once installed, the cover becomes suitable for use in transport. Additionally, the cover can be easily installed with the boat in the water. With the ratchet system and the use of the boat cleats, the cover can be attached around the top deck starting at the rear cleat(s). In one embodiment, the ratchet system includes ratchets on each side so an individual can work to that location regardless of the side on which the boat is docked.

In an exemplary embodiment, a playpen cover for a pontoon boat includes a cover panel sized to cover a pontoon boat deck, where the cover panel has loop channel. A ratchet loop is disposed in the loop channel and is attachable at ends of the ratchet loop to respective boat cleats. A ratchet system cooperable with the ratchet loop is disposed between the boat cleats. The loop channel may include a sewn hem in the cover panel. The ratchet system may include a first ratchet cooperable with the ratchet loop and disposed adjacent one side of the cover panel and a second ratchet cooperable with the ratchet loop and disposed adjacent an opposite side of the cover panel. The ratchet loop may be attachable to the respective boat cleats without a fastener. In this context, the ratchet loop may be attachable to the respective boat cleats by wrapping the ends of the ratchet loop around the respective boat cleats. At least one side of the cover panel may be scalloped. The cover panel may also include a u-shaped zipper opening in a front portion thereof.

In another exemplary embodiment, a quick-install boat cover includes a cover panel sized to cover a boat deck, the cover panel including loop channel; a ratchet loop disposed in the loop channel, where the ratchet loop is attachable at ends of the ratchet loop to respective boat cleats without a fastener; and a ratchet system cooperable with the ratchet loop and disposed between the boat cleats, where the ratchet system has at least one ratchet that draws and releases tension on the ratchet loop.

In yet another exemplary embodiment, a method of installing a boat cover includes the steps of (a) positioning a cover panel over a boat deck, the cover panel including loop channel and a ratchet loop disposed in the loop channel; (b) securing ends of the ratchet loop to respective boat cleats; and (c) using a ratchet system cooperable with the ratchet loop to draw and release tension on the ratchet loop. In one embodiment, step (b) is practiced by wrapping the ends of the ratchet loop around the boat cleats.

BRIEF DESCRIPTION OF THE DRAWINGS

These and other aspects and advantages will be described in detail with reference to the accompanying drawings, in which.

DETAILED DESCRIPTION OF THE INVENTION

With reference to the drawings, the cover includes a cover panel 10 generally sized to cover a pontoon boat deck. The cover may be formed of any suitable material including, without limitation, dyed polyesters, solution dyed acrylics, vinyl materials, canvas duck materials, and the like. A bottom portion of the cover panel is provided with a loop channel 12. Preferably, the loop channel 12 is a sewn hem in the cover panel 10. A ratchet loop 14 is disposed in the loop channel 12 and is attachable at ends thereof to respective boat cleats 16. The ratchet loop 14 extends in the loop channel 12 across at least three sides of the cover including the side shown in FIGS. 1 and 2, the front shown in FIG. 4, and the opposite side. An opposite end of the ratchet loop 14 is preferably secured to a corresponding boat cleat on an opposite side of the boat.

Figure 3:
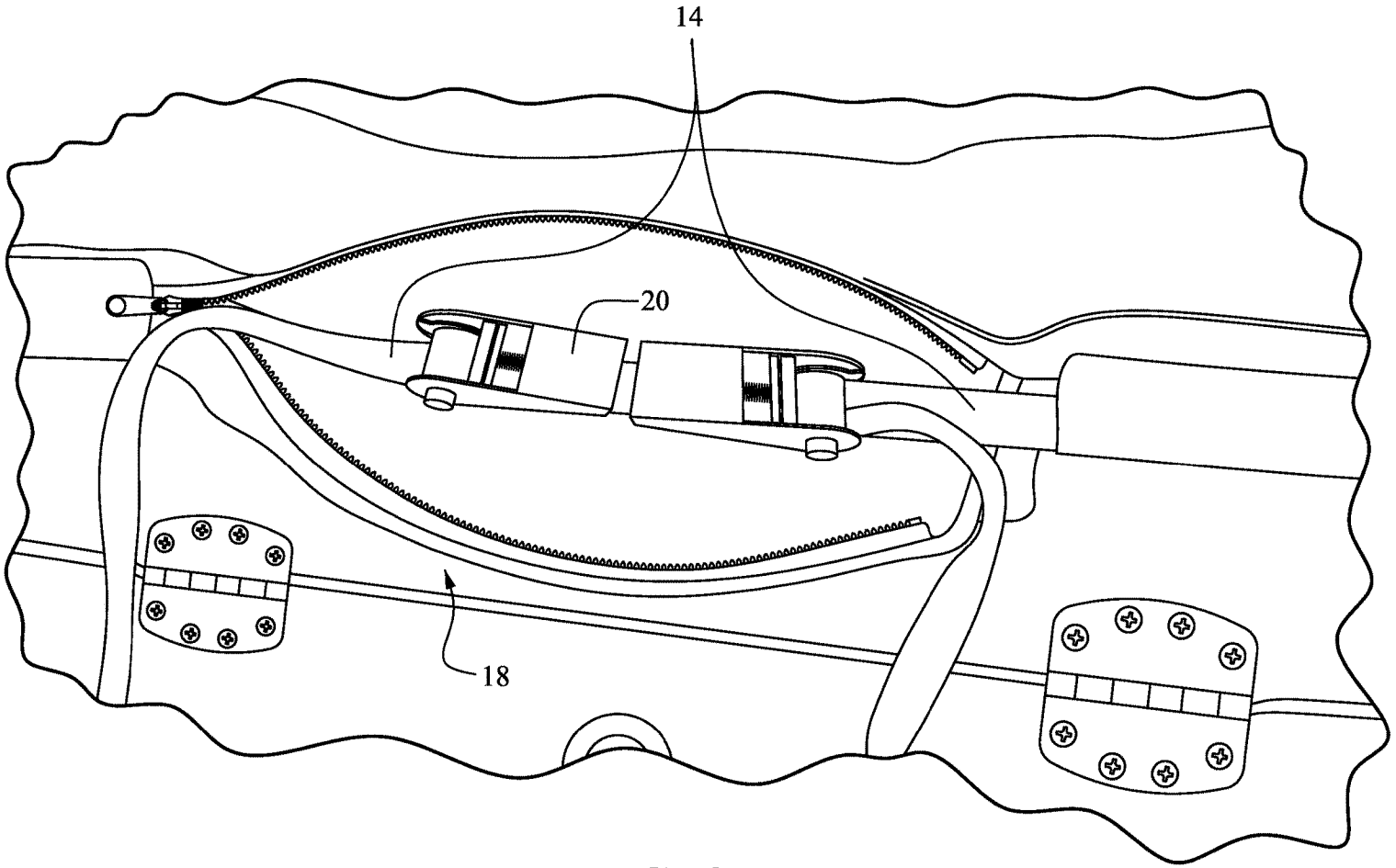
FIG. 3 is a close-up view of a ratchet cooperable with the ratchet loop.

A ratchet system 18 is cooperable with the ratchet loop 14 and is disposed between the boat cleats 16. With reference to FIG. 3, the ratchet system 18 includes a conventional ratchet 20 and serves to draw and release tension on the ratchet loop 14. Preferably, the ratchet system includes a first ratchet cooperable with the ratchet loop and disposed adjacent one side of the cover panel 10 and a second ratchet cooperable with the ratchet loop 14 and disposed adjacent an opposite side of the cover panel 10. With the ratchets provided on opposite sides of the cover, the ratchet loop 14 can be secured or released from either side of the boat. In an alternative embodiment, only a single ratchet 20 is disposed adjacent one side of the cover panel 10.

The ratchet loop 14 is readily attachable to the boat cleats 16 and thus requires no fastener. That is, the ratchet loop 14 may be attachable to the respective boat cleats 16 by wrapping ends of the ratchet loop 14 around the respective boat cleats 16.

Figure 1:
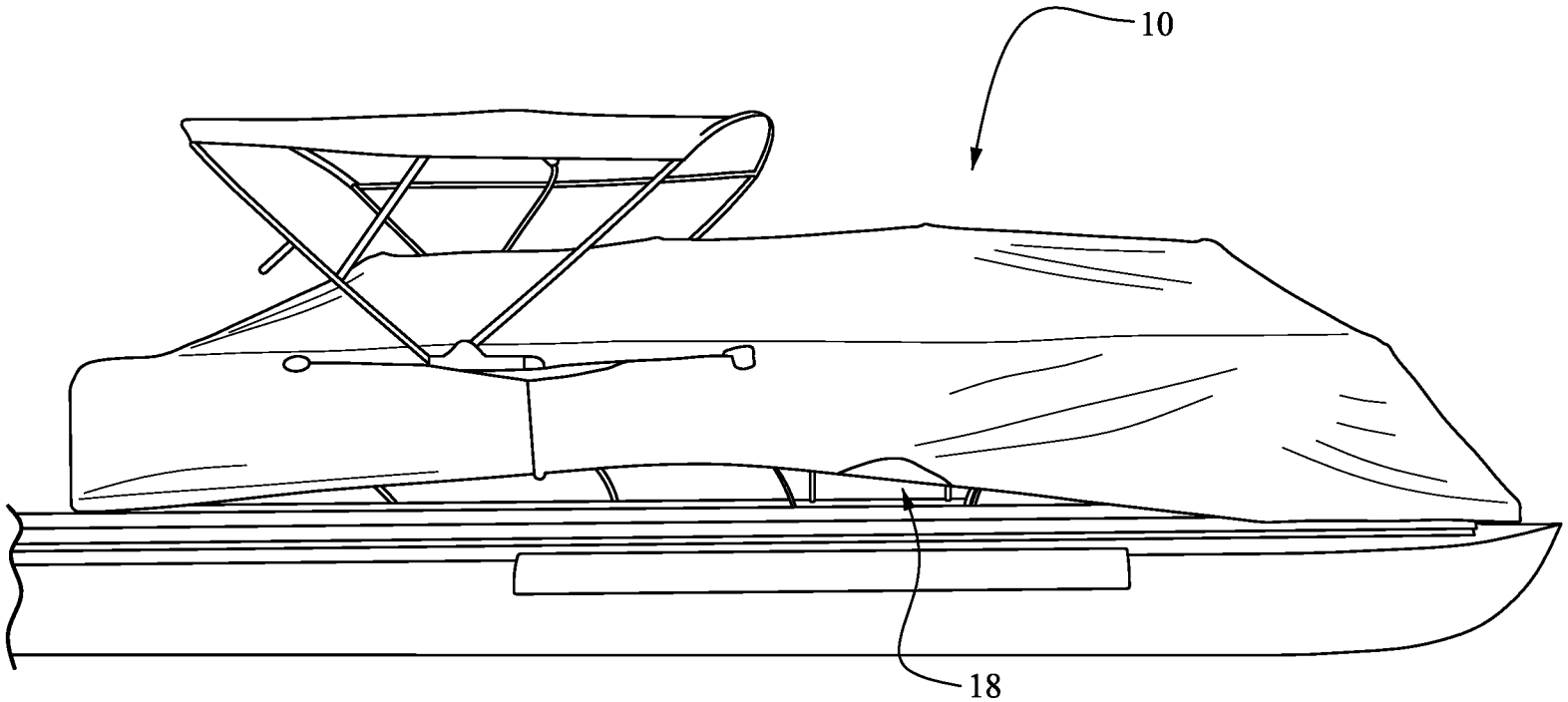
FIG. 1 is a side view of the boat cover installed on a pontoon boat.
Figure 2:
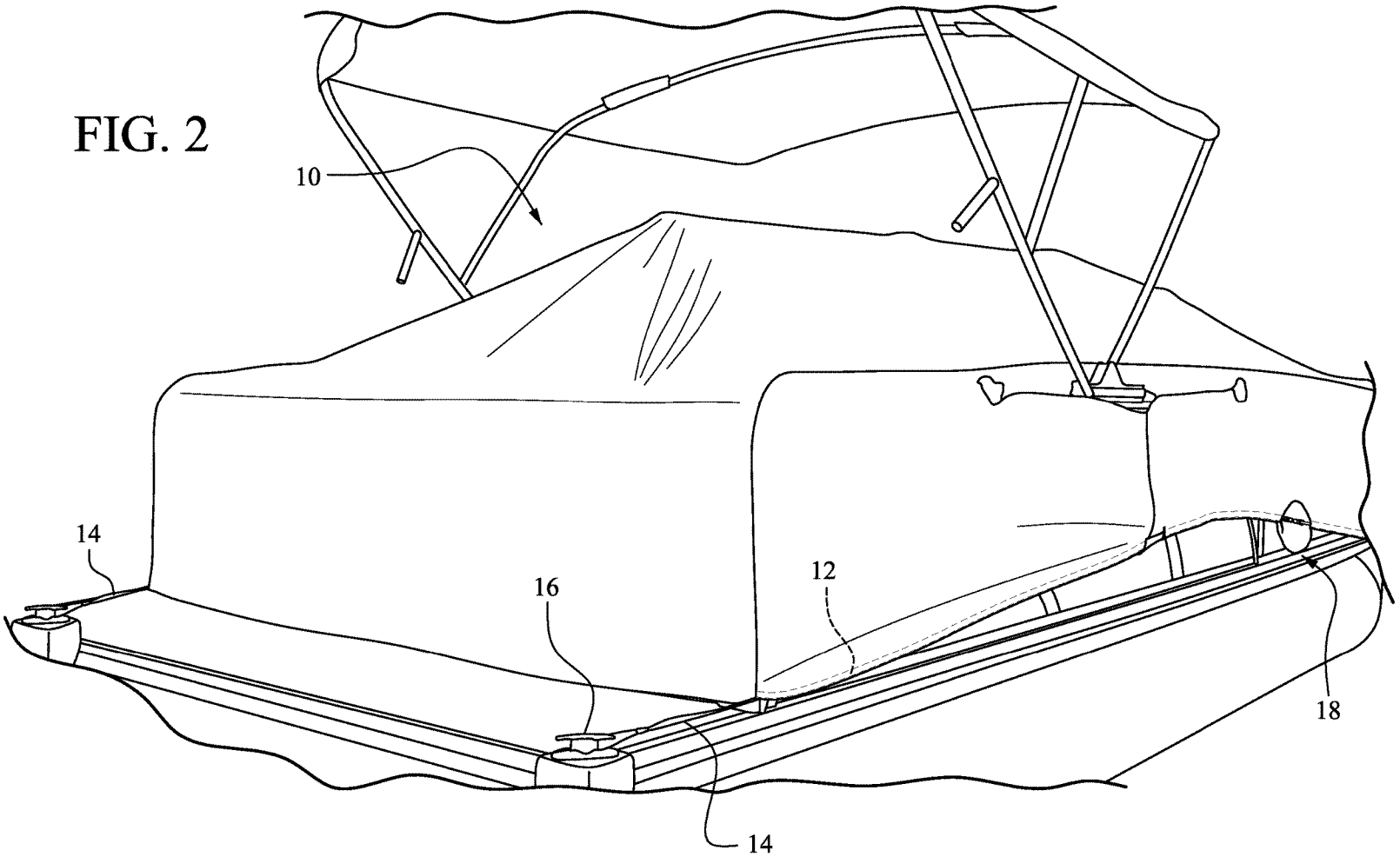
FIG. 2 is a rear perspective view showing the ratchet loop secured to a boat cleat.

As shown in FIGS. 1 and 2, at least one side of the cover panel 10 may be scalloped. The scalloped section shown in the drawings accommodates the tension in the ratchet loop 14 and provides for downward pulling power. That is, scalloping the cover allows for a tensioning effect between a long span of material. By doing this it eliminates the need for fasteners along this span.

Figure 4:
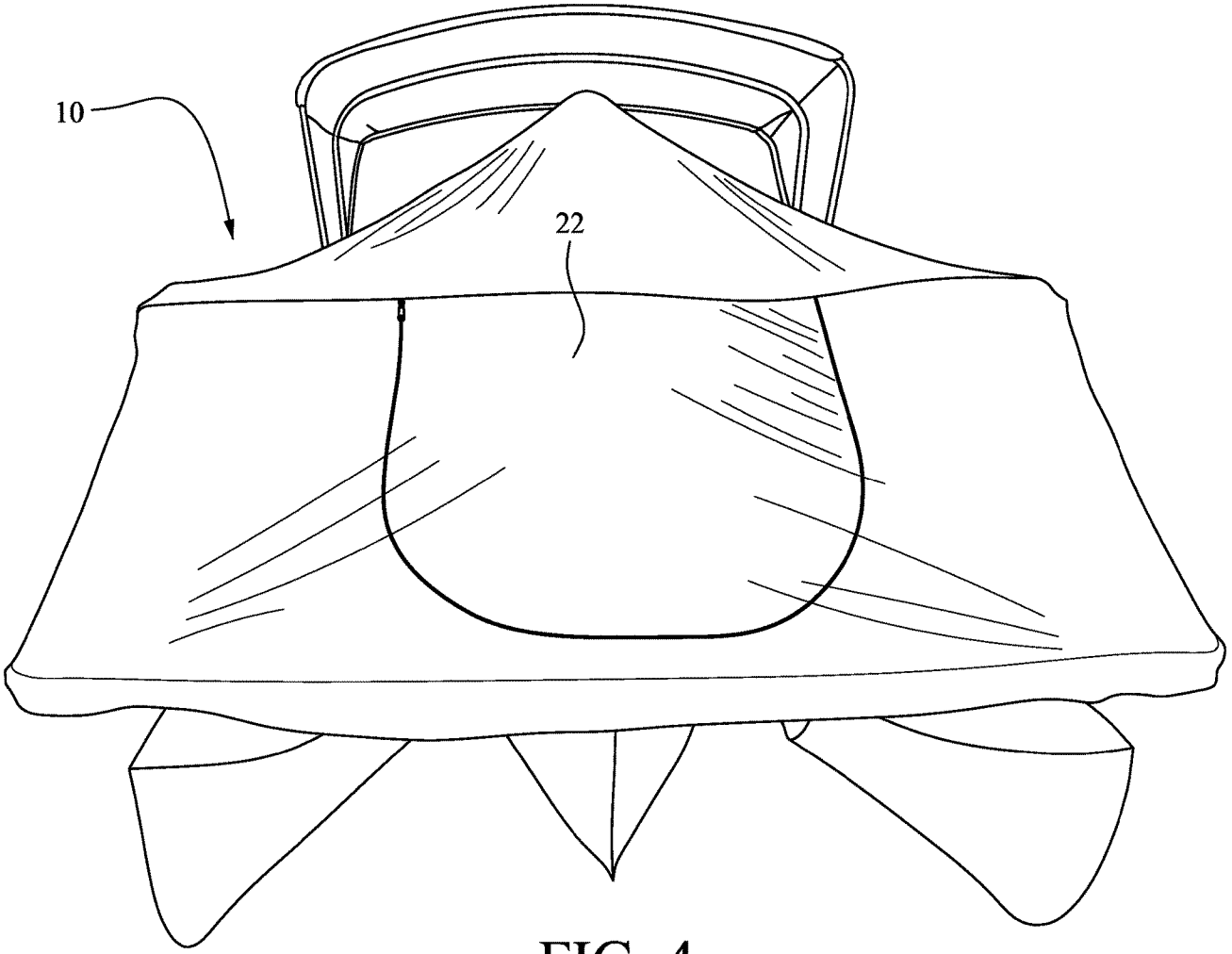
FIG. 4 is a front view of the boat cover showing a U-shaped zipper opening in a front portion thereof.

The cover panel 10 may additionally include a U-shaped zipper opening 22 in a front portion thereof (see FIG. 4). The U-shaped zipper portion 12 provides access to the boat deck with the cover in place. The zipper portion also provides an exit or entry point onto the front of the boat.

In order to install the boat cover, the cover panel 10 is positioned over the boat deck, and ends of the ratchet loop 14 are secured to respective boat cleats 16. Using the ratchet system 18, the ratchet loop 14 is drawn in tension to secure the boat cover in place. Once installed, the cover is suitable for transport or for use while the boat is moored in the water.

By securing the ratchet loop to an existing boat cleat, additional fasteners are not required for securing the boat cover to the boat. In this manner, the installation time for a boat cover can be significantly reduced. The cover is preferably designed to grab a front portion of the pontoon deck and lock itself from slipping off when ratcheted down slightly. The cover can be kept adjusted in that manner so there is always some tension when the cover is taken off. The front of the deck can be easily grabbed when the cover is installed time after time.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A playpen cover for a pontoon boat, comprising:

a cover panel sized to cover a pontoon boat deck, the cover panel having a port side and a starboard side and including loop channel;

a ratchet loop disposed in the loop channel, wherein the ratchet loop is attachable at ends of the ratchet loop to respective boat cleats; and a ratchet system cooperable with the ratchet loop and disposed between the boat cleats, wherein at least one of the port side and the starboard side of the cover panel is scalloped such that the loop channel is upwardly curved along at least a middle portion between the boat cleats.

2. A playpen cover for a pontoon boat according to claim 1, wherein the loop channel comprises a sewn hem in the cover panel.

3. A playpen cover for a pontoon boat according to claim 1, wherein the ratchet system comprises a first ratchet cooperable with the ratchet loop and disposed adjacent one side of the cover panel and a second ratchet cooperable with the ratchet loop and disposed adjacent an opposite side of the cover panel.

4. A playpen cover for a pontoon boat according to claim 1, wherein the ratchet system comprises a ratchet cooperable with the ratchet loop and disposed adjacent a side of the cover panel.

5. A playpen cover for a pontoon boat according to claim 1, wherein the ratchet loop is attachable to the respective boat cleats without a fastener.

6. A playpen cover for a pontoon boat according to claim 5, wherein the ratchet loop is attachable to the respective boat cleats by wrapping the ends of the ratchet loop around the respective boat cleats.

7. A quick-install boat cover comprising:

a cover panel sized to cover a boat deck, the cover panel having a port side and a starboard side and including loop channel;

a ratchet loop disposed in the loop channel, wherein the ratchet loop is attachable at ends of the ratchet loop to respective boat cleats without a fastener; and a ratchet system cooperable with the ratchet loop and disposed between the boat cleats, the ratchet system including at least one ratchet that draws and releases tension on the ratchet loop, wherein at least one of the port side and the starboard side of the cover panel is scalloped such that the loop channel is upwardly curved along at least a middle portion between the boat cleats.

8. A quick-install boat cover according to claim 7, wherein the loop channel comprises a sewn hem in the cover panel.

9. A quick-install boat cover according to claim 7, wherein the ratchet system comprises two ratchets that draw and release tension on the ratchet loop including a first ratchet cooperable with the ratchet loop and disposed adjacent one side of the cover panel and a second ratchet cooperable with the ratchet loop and disposed adjacent an opposite side of the cover panel.

10. A playpen cover for a pontoon boat according to claim 1, wherein the cover panel further comprises a u-shaped zipper opening in a front portion thereof.

11. A quick-install boat cover according to claim 7, wherein the cover panel further comprises a u-shaped zipper opening in a front portion thereof.

12. A playpen cover for a pontoon boat according to claim 1, wherein the scalloped side of the cover panel is without fasteners.

13. A quick-install boat cover according to claim 7, wherein the scalloped side of the cover panel is without fasteners.

* * * * *